US007462119B2

(12) United States Patent
Kelly

(10) Patent No.: US 7,462,119 B2
(45) Date of Patent: Dec. 9, 2008

(54) SPHERICAL GAME BALL WITH IMPROVED PANELS

(75) Inventor: Brian Kelly, Springfield, MA (US)

(73) Assignee: Russell Corporation, Atlanta, GA (US)

( * ) Notice: Subject to any disclaimer, the term of this patent is extended or adjusted under 35 U.S.C. 154(b) by 324 days.

(21) Appl. No.: 11/071,035

(22) Filed: Mar. 3, 2005

(65) Prior Publication Data

US 2006/0199684 A1 Sep. 7, 2006

(51) Int. Cl.
*A63B 41/08* (2006.01)

(52) U.S. Cl. ..... 473/604; 473/599

(58) Field of Classification Search ..... 473/603–605, 473/596, 597, 599, 607; 40/327; D21/713
See application file for complete search history.

(56) References Cited

U.S. PATENT DOCUMENTS

D199,535 S * 11/1964 Doss ..... D21/713
4,170,352 A * 10/1979 Vcala ..... 473/459
D352,317 S * 11/1994 Bassignani ..... D21/713
D393,020 S * 3/1998 Arcos ..... D21/713
D393,030 S * 3/1998 Mills ..... D21/713
D408,877 S * 4/1999 Sonntag et al. ..... D21/713
D416,961 S * 11/1999 Sonntag et al. ..... D21/713
D473,275 S * 4/2003 Gundra ..... D21/713
D510,113 S * 9/2005 Kelly ..... D21/713
6,988,969 B2 * 1/2006 Avis ..... 473/599
7,037,224 B1 * 5/2006 Page et al. ..... 473/604
2003/0203779 A1 * 10/2003 Avis ..... 473/604

* cited by examiner

*Primary Examiner*—Steven Wong

(57) ABSTRACT

A game ball with improved panels is disclosed, including panels stitched together to cover an inflatable bladder and forming a substantially spherical surface. There are two pluralities of panels, each plurality having a different color. At least one panel in one of the two pluralities has a textured surface. The panels in the first plurality are equidistant from each other on the spherical surface. Each panel in the first plurality is separated from all other panels in the first plurality by at least one panel in the second plurality.

12 Claims, 7 Drawing Sheets

SPHERICAL GAME BALL WITH IMPROVED PANELS

FIELD OF THE INVENTION

The present invention relates generally to game balls, and, more particularly, to a spherical game ball with improved panels.

BACKGROUND

Sports involving spherical game balls, such as basketball, soccer, and volleyball, are enjoyed by millions of spectators and players around the world. An important characteristic of these game balls is how visible the ball is to a spectator or a player. The games are played in a wide variety of lighting conditions. For example, games are played outdoors, indoors, under artificial light, under natural light, in bright sunlight, and at twilight. Ball visibility is affected by the color or colors used on the ball, yet in most game balls the color(s) is chosen based on aesthetics or tradition. Some attempts have been made to produce high-visibility balls using bright, fluorescent colors. Another approach has been to provide a light source within the ball, for example, an LED. Yet another approach uses phosphorescent pigments which absorb and then re-emit light. However, these approaches are relatively expensive. Thus, a heretofore unaddressed need exists in the industry to address the aforementioned deficiencies and inadequacies.

SUMMARY

An embodiment of a game ball in accordance with the invention includes panels stitched together to cover an inflatable bladder and forming a substantially spherical surface. There are two pluralities of panels, each plurality having a different color. At least one panel in one of the two pluralities has a textured surface. The panels in the first plurality are equidistant from each other on the spherical surface. Each panel in the first plurality is separated from all other panels in the first plurality by at least one panel in the second plurality.

Other features and/or advantages in addition to, or in lieu of, those presented above will be or may become apparent to one with skill in the art upon examination of the following drawings and detailed description. It is intended that all such additional features and/or advantages be included herein within the scope of the present invention.

DESCRIPTION OF THE DRAWINGS

The disclosed game ball can be better understood with reference to the following drawings. The components in the drawings are not necessarily to scale, emphasis instead being placed upon clearly illustrating the principles of the ball. Moreover, in the drawings, like reference numerals designate corresponding parts throughout the several views.

DETAILED DESCRIPTION

Figure 1:
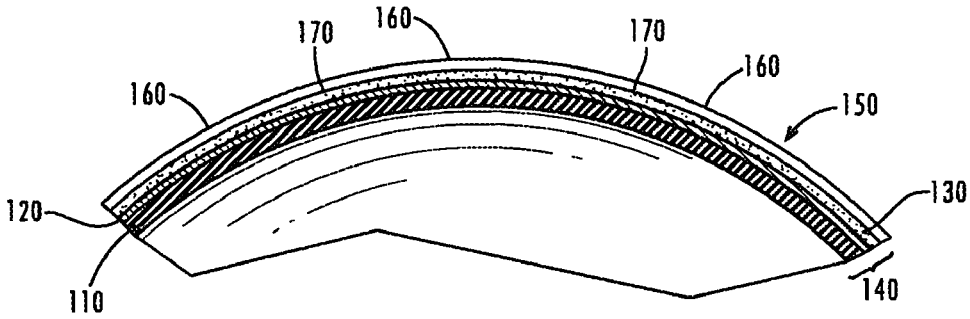
FIG. 1 is a fragmentary sectional view of the game ball with improved panels.

FIG. 1 is a fragmentary sectional view of the spherical game ball with improved panels. In the center is an inflatable bladder 110, which is typically made of some type of rubber, such as butyl or latex. One or more layers of thread are wound around the central bladder to form linings 120. The linings reinforce the bladder, helping the ball to retain its shape and structure under the stress caused by inflation and impact. The threads may be polyester, nylon, cotton, or any suitable material. The threads may be monofilament, or may be bonded or laminated together for additional strength.

The bladder 110 and linings 120 thus define the shape of the ball. A layer of cushioning material 130 is shown in FIG. 1 surrounding the linings 120, though this layer is optional. The cushion layer 130 acts to reduce the force of the ball's impact on a player, and improves the player's grip on the ball. The bladder 110, linings 120, and optional cushion 130 form the carcass 140.

A cover 150 composed of multiple panels 160 surrounds the carcass 140. The cover 150 may be made natural leather, or from synthetic material such as polyurethane or polyvinyl chloride. The panels 160 are separated by grooves 170. The panels 160 are two different colors, and the colored panels are arranged about the spherical surface in a contrasting manner, as will be described in connection with FIGS. 2 and 3. When the ball is in motion, this contrasting color arrangement improves the visibility of the ball's path through the air or on the ground. The improved visibility afforded by the contrasting color arrangement is an advantage to both players and spectators.

FIGS. 2A-D are side views of one embodiment of the game ball with improved panels, each view being rotated laterally 90.degree. from the previous view so that all sides of the ball are visible from the combined views. Taken together, these views illustrate the contrasting color arrangement. Panels 160 are stitched together around carcass 140 to form the spherical surface 210 of the ball as shown. Panels 220*a-d* form a first panel group 220. Panels 230*a-n*form a second panel group 230. As can be seen in FIGS. 2A-2D, the center of each panel in the first panel group is equidistant (on the spherical surface) from the center of each other panel in that same group. The panels in group 220 are one color. The panels in group 230 are another color, different than the color of group 220. The colors substantially fill the area of each of the panels. In one embodiment, for example, the panels in group 220 are black, and the panels in group 230 are red. However, other color combinations may be used. Some or all of the colored panels may also be imprinted with a logo or design.

Figure 2A:
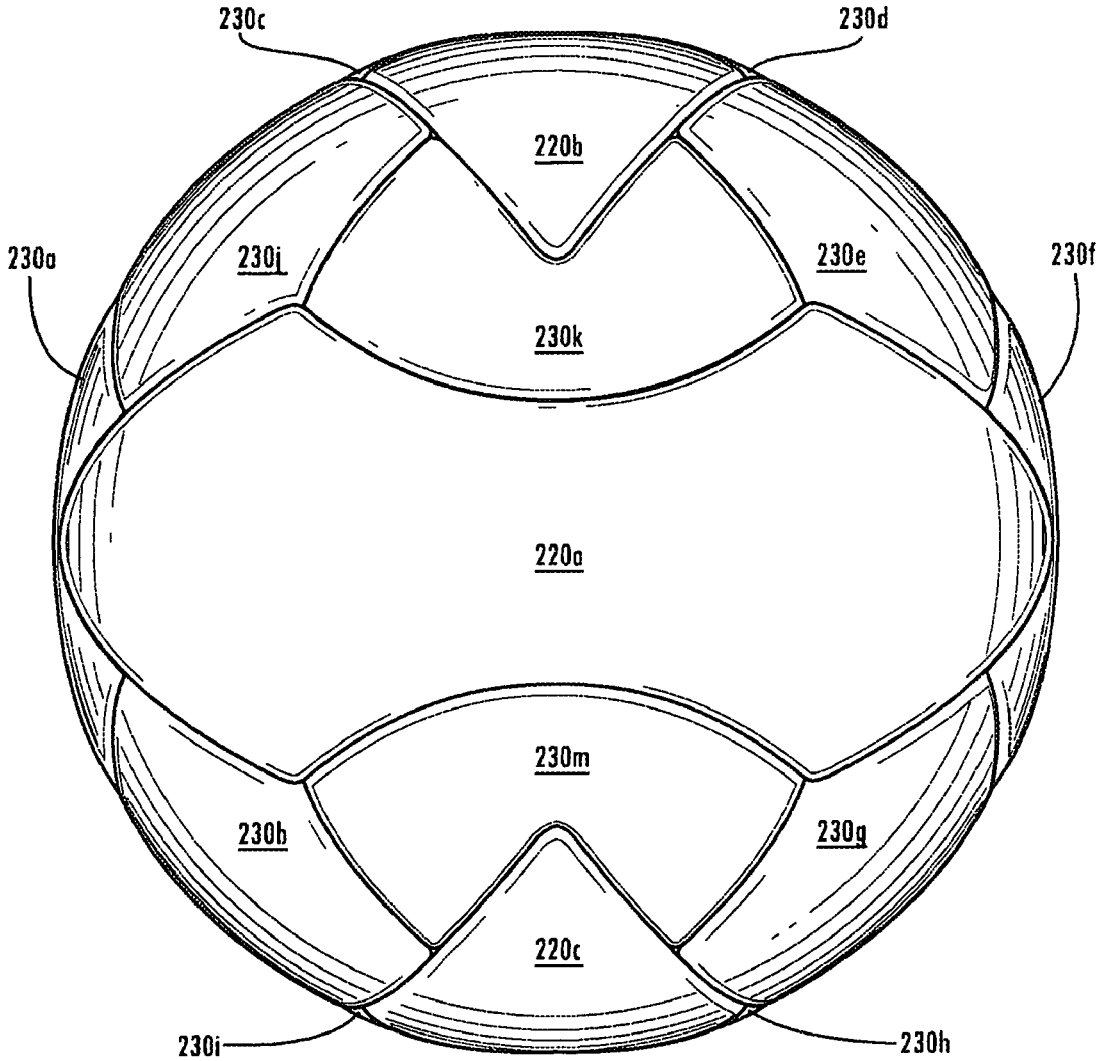
FIGS. 2A-D are side views of one embodiment of the game ball with improved panels, each view being rotated laterally 90° from the previous view so that all sides of the ball are visible from the combined views.
Figure 2B:
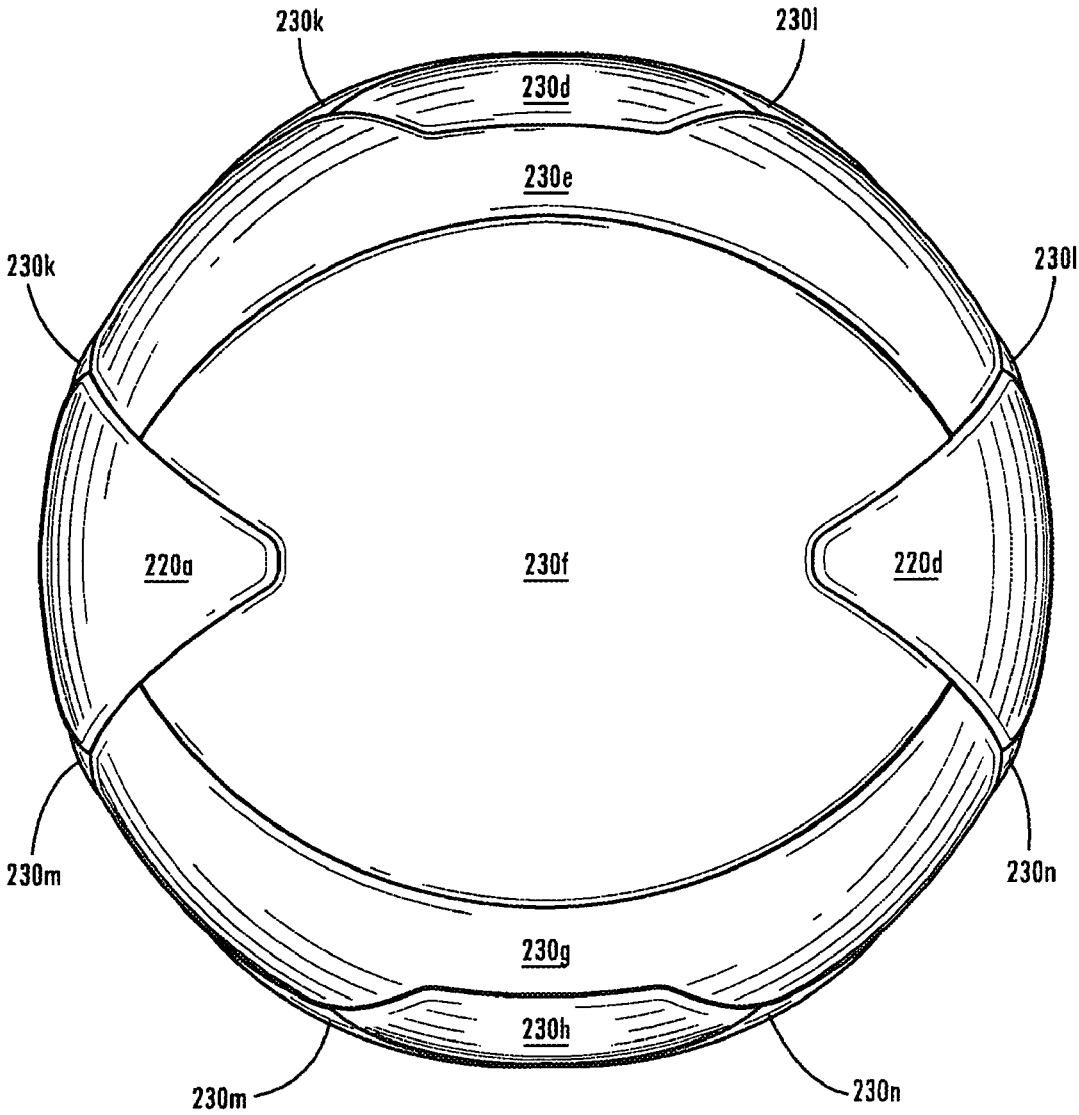
Figure 2C:
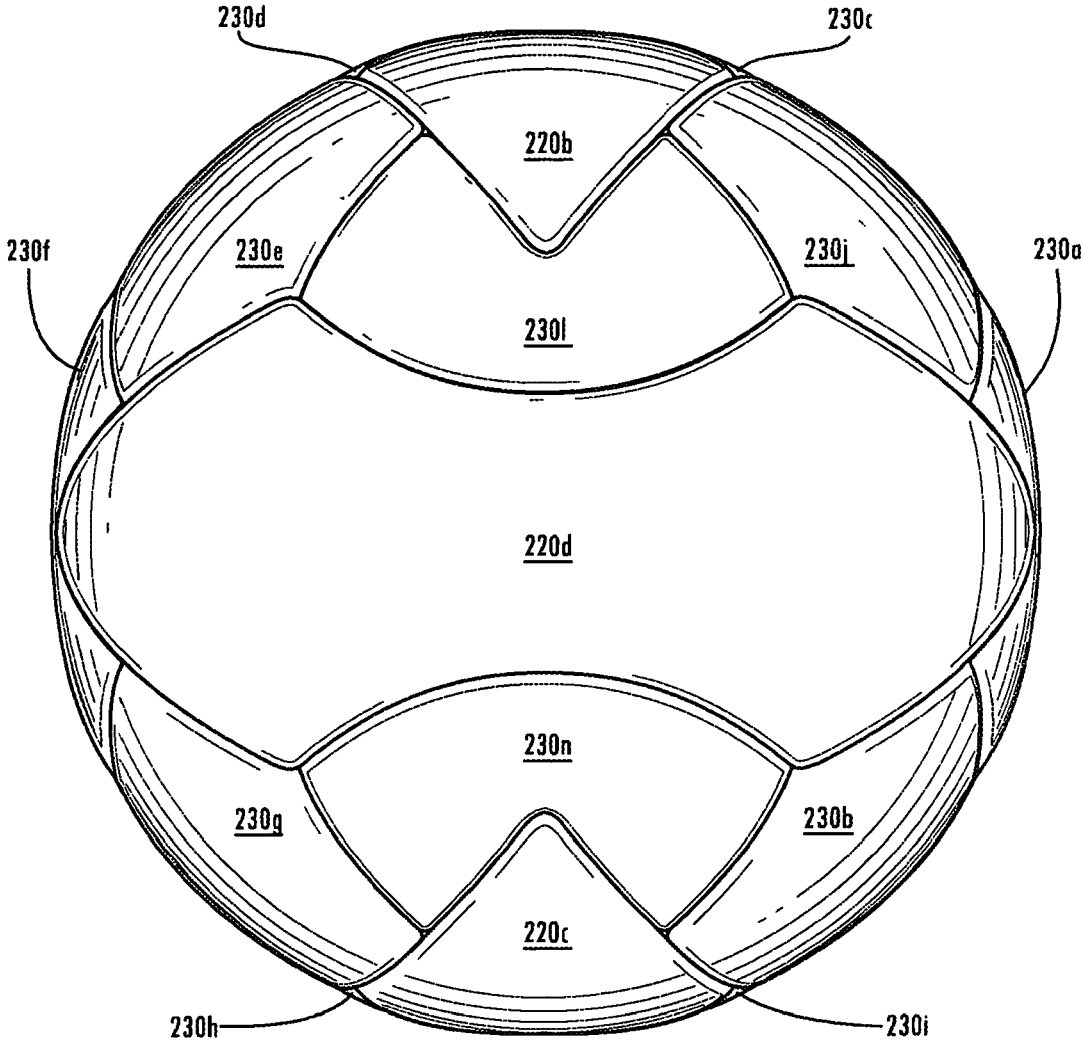
Figure 2D:
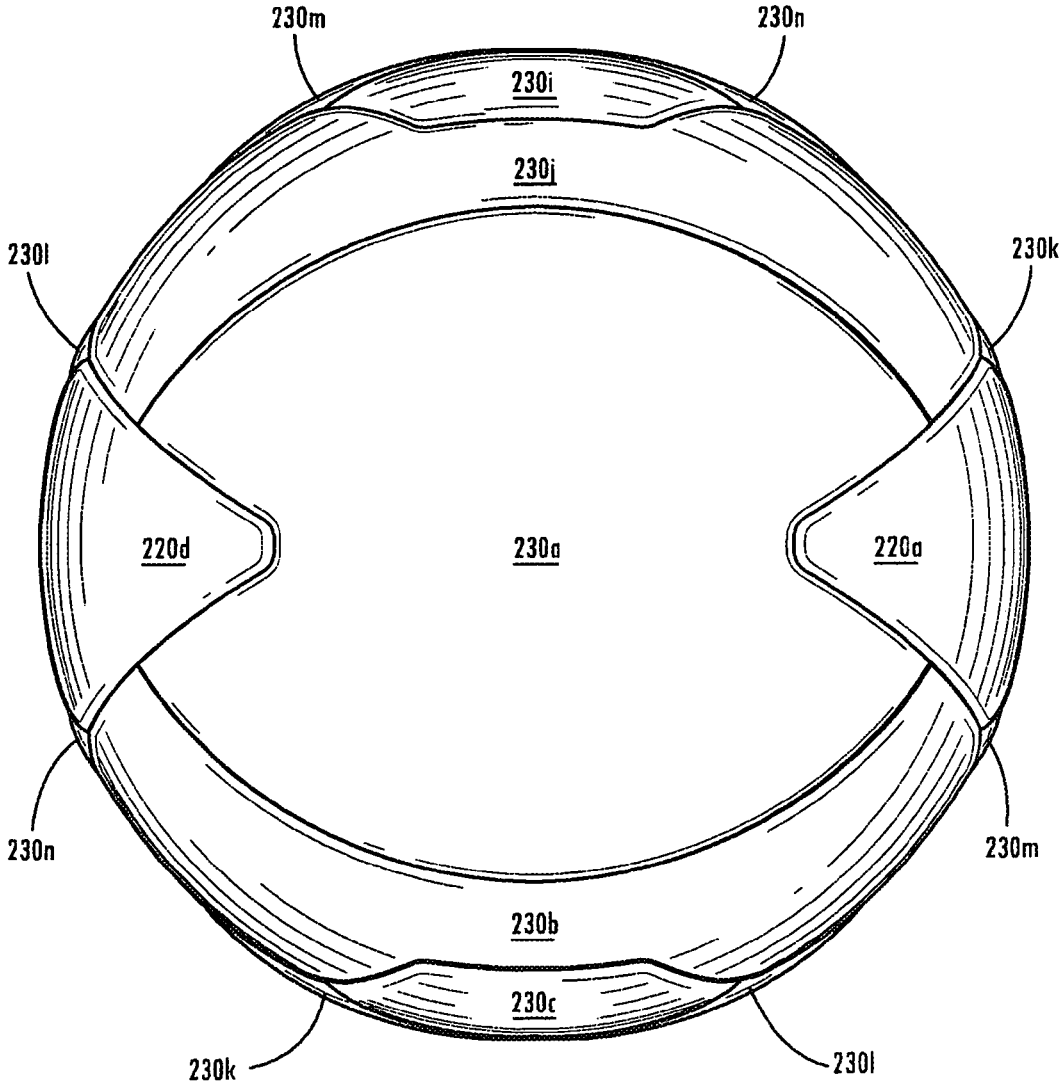
Figure 3:
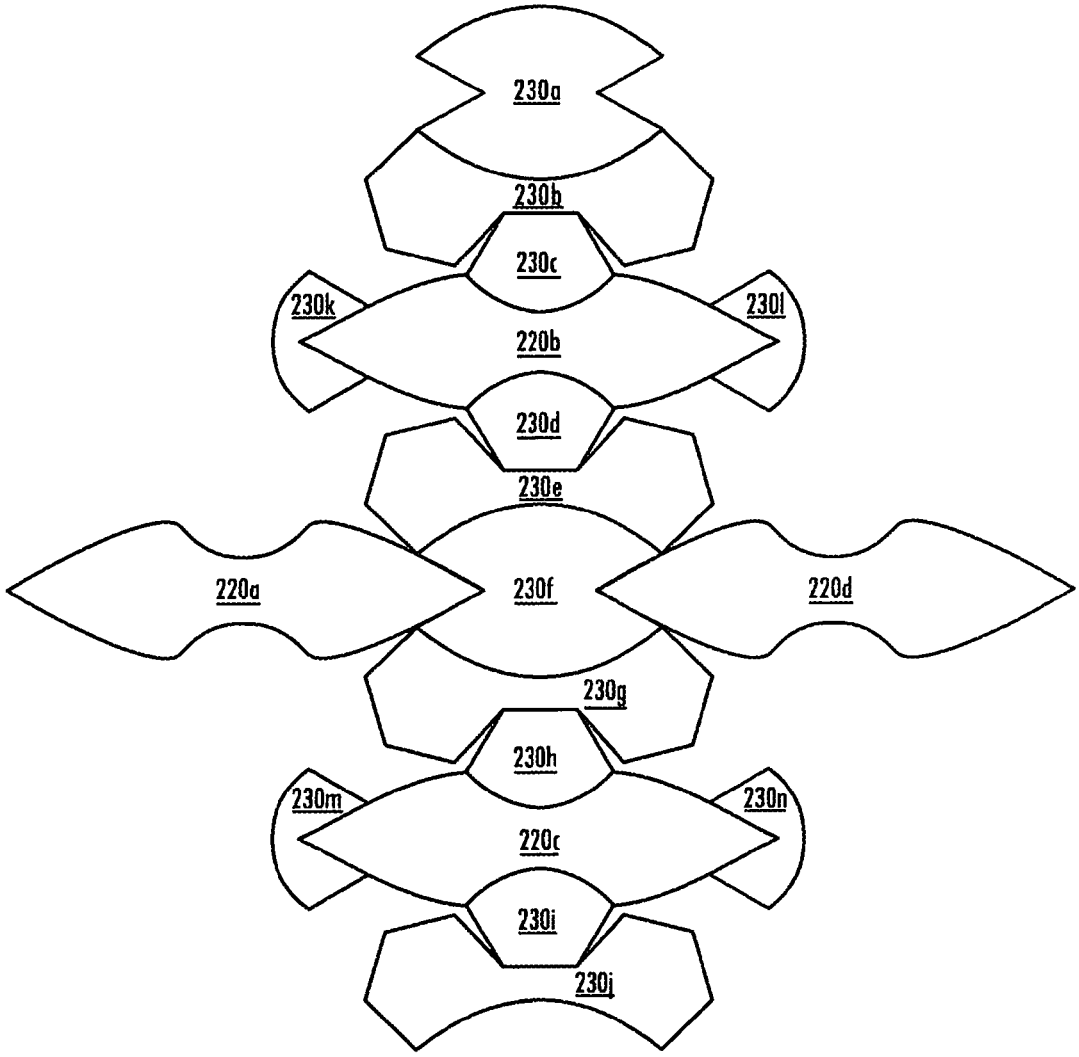
FIGS. 3A-B are top views of exemplary embodiments of the game ball cover.

Panels in the first group 220 are equidistant from each other on the spherical surface, and separated from each other by the panels of second group 230, so that no two panels in first group 220 are adjacent to each other. In the preferred embodiment illustrated in FIGS. 2A-D, there are a total of eighteen panels: four in the first group 220 (220*a-d*) and fourteen (230*a-n*) in the second group 230. Other combinations are possible, for example, two panels in the first group 220 and sixteen in the second group 230. Panels of the first group 220 include a major axis and a minor axis. In the exemplary embodiments of FIGS. 2A and 2C, one of ordinary skill in the art would understand that the major axis is the longer horizontal axis of the panels of the first group 220. As illustrated, panels of the first group 220 have two opposing sides about the major axis, each side has an interior portion with a concave shape with respect to the major axis and two end portions separated by the interior portion and having a convex shape with respect to the major axis. In FIGS. 2A and 2C, the corresponding end portions of the two opposing sides meet at an apex on the major axis.

Another feature of the game ball with improved panels is also illustrated in FIGS. 2A-D. Some of the panels have a textured surface 240, which provides better grip for the player's hands and/or feet, thus allowing the player to better control the path of the ball. The texture may be a pebbled texture that simulates the texture of pebble-grain leather. In one embodiment, other panels have a substantially smooth surface 250 rather than a textured surface. The arrangement of textured and smooth surfaces allows a player to identify by feel which portion of the ball he is touching. In the preferred embodiment, the equidistant panels in the first group 220 are smooth, while the other panels, in the second group 230, are textured.

Figure 3A:
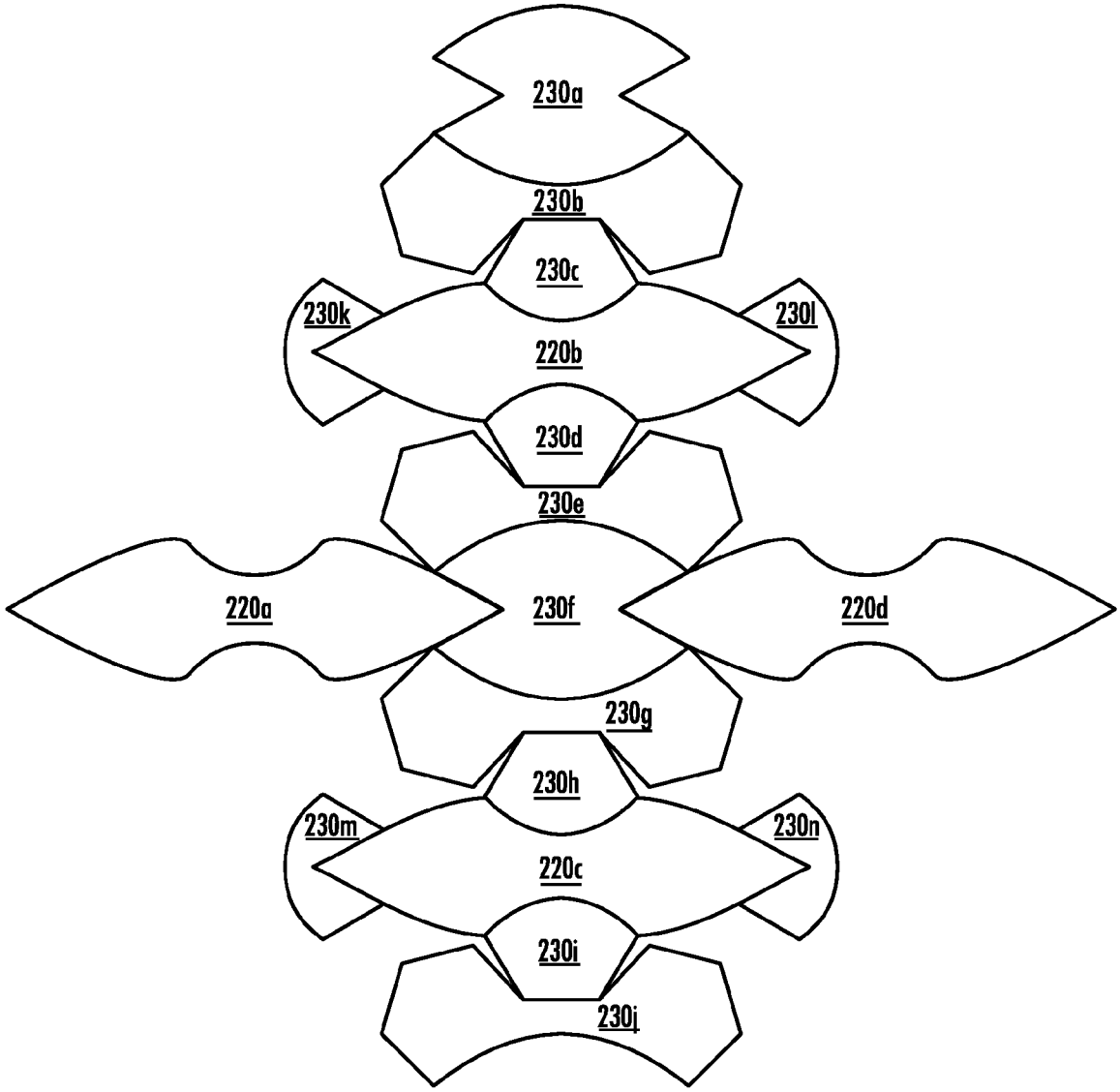

FIG. 3A is a top view of one embodiment of the game ball cover, in its unstitched form. In this preferred embodiment, cover 150, which comprises multiple panels 160, is cut from a single piece of material. With this single-piece design, only the edges of cover 150 are stitched together around carcass 140 to form the spherical surface of FIGS. 2A-D, thus requiring less stitching than would be needed with separate panels. The shape and relative size of the panels 160 can vary in the following ways.

Figure 3B:
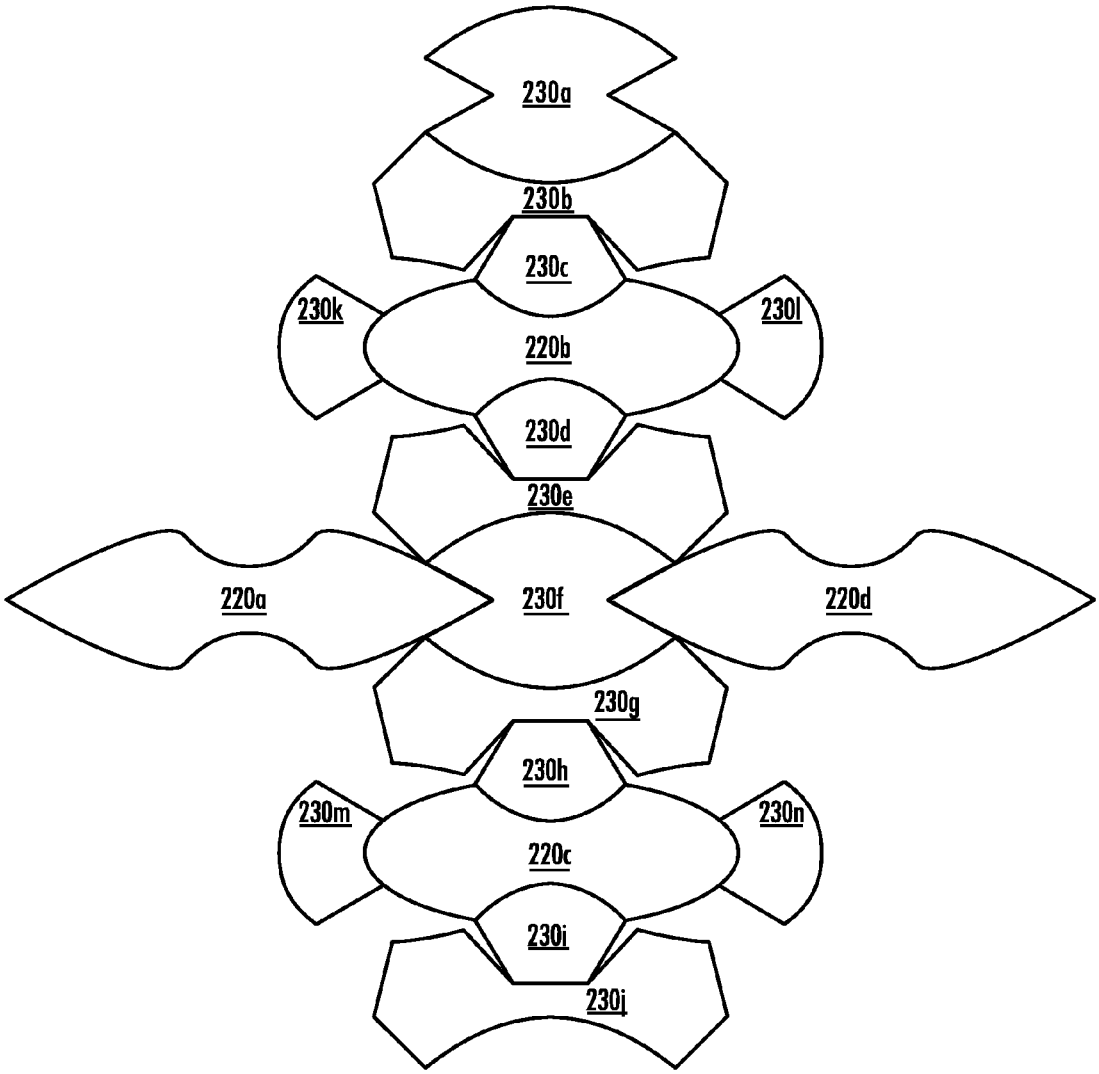

In this example embodiment, there are four panels in the first group 220 (220*a-d*), divided into a first pair of panels 220*a* and 220*d* and a second pair of panels 220*b* and 220*c*. The two panels in the first pair 220*a* and 220*d* have a first shape, and the two panels in the second pair 220*b* and 220*c* have a second shape. The first shape and the second shape are substantially the same. The two panels in the first pair 220*a* and 220*d* are also substantially the same size as the two panels in the second pair 220*b*and 220*c*. In another embodiment, the two panels in the first pair 220*a* and 220*d* are the same shape, and the two panels in the second pair 220*b* and 220*c* are the same shape, but this second shape is different than the shape of the first pair 220*a* and 220*d*. For example, in the exemplary embodiment of FIG. 3B, the panels in the first pair 220*a* and 220*d* are substantially the same size and have a first shape. The panels in the second pair 220*b* and 220*c* are substantially the same size and have a second shape different than the first shape.

In this example embodiment, the shape of the panels in the first group 220 is different than the shape of the panels in the second group 230. That is, none of the panels in the second group 230 have the first shape. In another embodiment, at least one panel in the second group 230 has a shape different than the first shape, but the remaining panels in the second group 230 have the first shape. In yet another embodiment, the panels in the first group 220 have multiple shapes, and at least one of the panels in the second group 230 is a shape different than at least one of these multiple shapes.

The foregoing description has been presented for purposes of illustration and description. It is not intended to be exhaustive or to limit the invention to the precise forms disclosed. Obvious modifications or variations are possible in light of the above teachings. The embodiments discussed, however, were chosen and described to illustrate the principles of the invention and its practical application to thereby enable one of ordinary skill in the art to utilize the invention in various embodiments and with various modifications as are suited to the particular use contemplated. All such modifications and variation are within the scope of the invention as determined by the appended claims when interpreted in accordance with the breadth to which they are fairly and legally entitled.

Therefore, having thus described the invention, at least the following is claimed:

1. A spheroidal game ball, comprising:

an inflatable bladder;

a first plurality of panels of a first color, each panel in the first plurality having two opposing sides about a major axis, each side having an interior portion with a concave shape with respect to the major axis and two end portions separated by the interior portion and having a convex shape with respect to the major axis, corresponding end portions of the two opposing sides meeting at an apex on the major axis; and a second plurality of panels of a second color different than the first color, the panels in the second plurality including a first subset having a first shape and a second subset having a second shape;

wherein the panels are stitched together to cover the bladder forming a substantially spherical surface, and when so stitched, the center of each panel in the first plurality is equidistant from the center of each other panel in the first plurality on the spherical surface, and each panel in the first plurality is separated from all other panels in the first plurality by at least one panel in the second plurality, wherein the first plurality of panels comprises four panels including a first and a second pair, the panels in the first pair having a first shape and being substantially the same size, and the panels in the second pair having a second shape different than the first shape and being substantially the same size, and wherein at least one panel in the second plurality has a textured surface and at least one panel in the first plurality has a substantially smooth surface.

2. The ball of claim 1, wherein at least one panel in either plurality has a textured surface.

3. The ball of claim 1, wherein the first color substantially fills the area of each of the panels in the first plurality.

4. The ball of claim 3, wherein the second color substantially fills the area of each of the panels in the second plurality.

5. The ball of claim 1, wherein the number of panels in the first plurality is less than the number of panels in the second plurality.

6. The ball of claim 1, wherein each of the four panels is substantially the same size and shape.

7. The ball of claim 1, wherein at least one of the second plurality of panels has a size and shape different than at least one panel in the first plurality.

8. The ball of claim 1, wherein at least one of the second plurality of panels has a size and shape different than all panels in the first plurality.

9. The ball of claim 1, wherein all of the second plurality of panels have a size and shape different than all panels in the first plurality.

10. The ball of claim 1, wherein the number of panels in the first and second pluralities combined is eighteen.

11. The ball of claim 1, wherein the opposing sides are mirror images with respect to the major axis.

12. The ball of claim 1, wherein the corresponding end portions of the two opposing sides form a point at the apex.

* * * * *